US010136734B2

(12) United States Patent
Dewitt

(10) Patent No.: US 10,136,734 B2
(45) Date of Patent: Nov. 27, 2018

(54) ELECTRICALLY-HEATED WEARABLE BLANKET WITH AUTO SHUT-OFF SWITCH

(71) Applicant: Renee Dewitt, Orlando, FL (US)

(72) Inventor: Renee Dewitt, Orlando, FL (US)

( * ) Notice: Subject to any disclaimer, the term of this patent is extended or adjusted under 35 U.S.C. 154(b) by 527 days.

(21) Appl. No.: 14/177,218

(22) Filed: Feb. 10, 2014

(65) Prior Publication Data

US 2014/0217081 A1 Aug. 7, 2014

Related U.S. Application Data

(63) Continuation of application No. 13/326,277, filed on Dec. 14, 2011, now Pat. No. 8,648,280.

(60) Provisional application No. 61/423,319, filed on Dec. 15, 2010.

(51) Int. Cl.

| | |
|---|---|
| ***H05B 3/20*** | (2006.01) |
| ***H05B 3/34*** | (2006.01) |
| ***A47C 21/04*** | (2006.01) |
| ***H05B 1/02*** | (2006.01) |
| ***H05B 3/06*** | (2006.01) |

(52) U.S. Cl.

CPC ..... *A47C 21/048* (2013.01); *H05B 1/0202* (2013.01); *H05B 1/0272* (2013.01); *H05B 3/06* (2013.01); *H05B 3/34* (2013.01); *H05B 2203/036* (2013.01)

(58) Field of Classification Search

CPC ... H05B 3/00; H05B 3/10; H05B 3/20; H05B 3/40; H05B 2203/036; H05B 2203/00; H05B 3/34

USPC ..... 219/527, 529, 535, 522, 219, 539, 211, 219/217, 212, 516, 528, 549, 541, 545; 607/96, 108–111; 338/307, 314; 2/247, 2/272

See application file for complete search history.

(56) References Cited

U.S. PATENT DOCUMENTS

| | | | | |
|---|---|---|---|---|
| 5,986,243 | A * | 11/1999 | Campf | A41D 13/0051 219/211 |
| 7,172,451 | B1 * | 2/2007 | Ratzlaff | H01R 13/6397 439/106 |
| 7,230,206 | B1 * | 6/2007 | Randall | A41D 13/0051 219/211 |
| 2005/0016982 | A1 * | 1/2005 | Campf | H05B 1/0272 219/212 |
| 2007/0093885 | A1 * | 4/2007 | Anderson | A61F 7/00 607/104 |
| 2008/0040839 | A1 * | 2/2008 | Gordon | A41D 13/0053 2/455 |
| 2008/0173629 | A1 * | 7/2008 | Deibel | A61F 7/007 219/212 |

* cited by examiner

*Primary Examiner* — Michael LaFlame, Jr.
(74) *Attorney, Agent, or Firm* — Eldredge Law Firm, LLC; Richard Eldredge; Beth Felix

(57) ABSTRACT

An electrically-heated wearable blanket with auto shut-off switch that includes a blanket portion disposed between a first edge, a second edge, a third edge, and a fourth edge, the blanket portion having a front surface and a back surface, wherein a person wearing the electrically-heated wearable blanket with auto shut-off switch is in operational communication with a boustrophedonic heating element disposed within the blanket portion by means of a control pad disposed on a first cord in circuit with the heating element, and a second cord releasably interconnects the heating element alternately among at least three external power sources including a rechargeable battery pack.

18 Claims, 8 Drawing Sheets

ELECTRICALLY-HEATED WEARABLE BLANKET WITH AUTO SHUT-OFF SWITCH

RELATED APPLICATIONS

This application is a continuation, and claims the benefit under 35 U.S.C. 120 of U.S. Original application Ser. No. 13/326,277 filed on 14 Dec. 2011, which is which claims the benefit under 35 U.S.C. 119(e) of U.S. Provisional Application Ser. No. 61/423,319, filed on 15 Dec. 2010.

1. Field of Invention

This disclosure relates to electrically-heated blankets.

2. Description of Related Art

Various types of electrically-heated blankets are known in the prior art.

BRIEF DESCRIPTION

The general purpose of the present electrically-heated wearable blanket with auto shut-off switch, described subsequently in greater detail, is to provide an electrically-heated wearable blanket with auto shut-off switch which has many novel features that result in an electrically-heated wearable blanket with auto shut-off switch which is not anticipated, rendered obvious, suggested, or even implied by prior art, either alone or in combination thereof.

In an era of ever increasing energy costs, a way to warm oneself efficiently and expediently is desirable. Wearing additional clothing such as sweaters in the home is practical but not always comfortable. In order to cool down when wearing multiple layers of clothing, a layer must be doffed. In order to warm up, a layer must be donned. Furthermore, additional layers of clothing lack a comfortable aspect—layers of clothing aren't cozy—and one often feels bulky and hampered.

A means to more easily control heat within a personal space is warranted, and, at the same time, provide a cozy experience for a person. The present electrically heated wearable blanket with auto shut-off switch, therefore, includes a blanket portion disposed between a first edge, a second edge, a third edge and a fourth edge. The blanket portion has a front surface and a back surface. When worn, the back surface is disposed proximal the body of a person wearing the device. The blanket portion is envisioned to be manufactured from wool, a synthetic fleece material, and alternatively a synthetic polymer such as nylon, for example.

A plurality of modes is considered for the device wherein a bostrophedonic heating element is disposed within the blanket portion, said heating element interconnectable among at least three external power sources including a standard 110 Volt outlet, an automobile cigarette lighter socket outlet, and a rechargeable battery pack. A plurality of modes is herein disclosed, but the abovementioned interconnectability among at least three external power sources to power the heating element within the blanket portion is considered a novel feature applicable to clothing, bedding, as well as a wearable electric 'fleece, among other examples.

In all envisioned embodiments, a boustophedonic heating element is disposed within the blanket portion. The heating element is envisioned to be a wire disposed boustrop hedonically throughout the blanket portion. The heating element is connected in circuit with a first cord having a control pad disposed endwise thereon. The control pad includes an on-off switch and a temperature control. When worn, the control pad is retrievable and accessible on the first cord, and the heating element is controllable between a minimum setting and a maximum setting, the heating element dissipating heat from an electrical current activated therethrough.

A second cord is also disposed from the front surface. The second cord is disposed proximal he second edge and the fourth edge. The second cord has a plug disposed endwise thereon, the plug configured to releasably interconnect alternately with a connector, the connector disposed on a proximal end of each of a third cord, a rechargeable battery pack, and fourth cord. The connector includes a pair of lock members, each of the pair of lock members extending from the connector to releasably engage with a pair of cavities disposed on the plug. The pair of lock members releasably secure the plug to the connector. A male portion of the plug interconnects with an interconnectable interface of the connector, and the first cord is thereby releasably connected in circuit with the third cord and alternately the fourth cord.

In the preferred embodiment herein disclosed, a pair of sleeves is disposed from the front surface of the blanket portion, each of the pair of sleeves disposed circumferentially around each of a pair of apertures. A person wearing the device inserts each of their arms into each of the pair of sleeves and the first edge of the blanket portion girdles the neckline of a person using the device. A first hook and loop fastener is disposed upon the first edge front surface, proximal the third edge. A second hook and loop fastener is disposed upon the first edge back surface, proximal the fourth edge. The first hook and loop fastener releasably engages with the second hook and loop fastener and the blanket portion is releasably secured by the first edge around a person's neckline. The first hook and loop fastener and the second hook and loop fastener are disposed proximal the nape of the neck of a person wearing the device.

The third cord has a standard two-pronged plug disposed endwise, the two-pronged plug removably insertable into an extant 110 Volt power outlet. The fourth cord has an automobile cigarette lighter socket plug disposed endwise, and the fourth cord is used to interconnect the electrically-heated wearable blanket with auto shut-off switch with an automobile cigarette lighter socket whereby the electrically-heated wearable blanket with auto shut-off switch is useable in an extant automobile, as preferred. The rechargeable battery pack is alternately connectable to the plug and removably insertable into a pocket disposed on the front surface of the device. The rechargeable battery pack is thusly portable upon the electrically-heated wearable blanket with auto shut-off switch, and a person wearing the device is able to move about freely, unencumbered by cords otherwise restricting use of the device to an extant proximal power outlet.

A hood portion is removably attachable to the back surface, the hood portion removably attachable proximal the first edge and the fourth edge. The hood portion releasably attaches to the back surface proximal the first and fourth edges by means of a pair of hook and loop fasteners releasably attaching an attachment portion of the hood portion to the blanket portion. When the hood is attached, and the blanket worn, the hood is aligned with the back of the head of a person wearing the device. The hood enables additional warming and comfort when wearing the device by enclosing a person's head. Thus has been broadly outlined the more important features of the present electrically-heated wearable blanket with auto shut-off switch so that the detailed description thereof that follows may be better understood and in order that the present contribution to the art may be better appreciated. Objects of the present electrically heated wearable blanket with auto shut-off and method, along with various novel features that characterize the invention are particularly pointed out in the claims forming a part of this disclosure. For better understanding of the electrically-heated wearable blanket with auto shut-off and method, its operating advantages and specific objects attained by its uses, refer to the accompanying drawings and description.

Apparatus, systems, and methods of varying scope are described herein. In addition to the aspects and advantages described in this summary, further aspects and advantages will become apparent by reference to the drawings and by reading the detailed description that follows.

DETAILED DESCRIPTION

Figure 1:
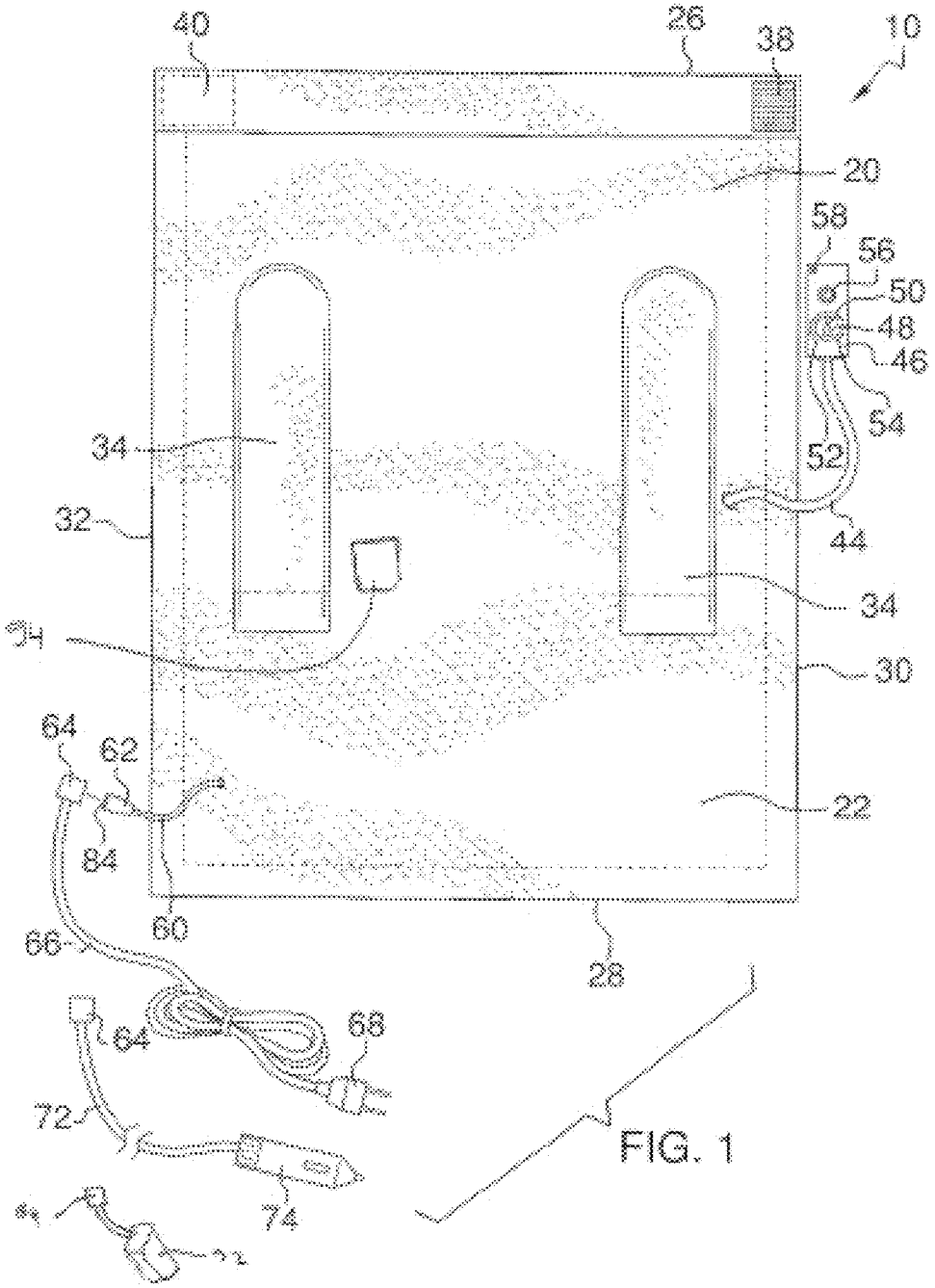
FIG. 1 is a front view.

In the following detailed description, reference is made to the accompanying drawings that form a part hereof, and in which is shown by way of illustration specific implementations which may be practiced. These implementations are described in sufficient detail to enable those skilled in the art to practice the implementations, and it is to be understood that other implementations may be utilized and that logical, mechanical, electrical and other changes may be made without departing from the scope of the implementations. The following detailed description is, therefore, not to be taken in a limiting sense.

With reference now to the drawings, and in particular FIGS. 1 through 7 thereof, example of the instant electrically-heated wearable blanket with auto shut-off switch employing the principles and concepts of the present electrically-heated wearable blanket with auto shut-off switch and generally designated by the reference number 10 will be described.

Referring to FIGS. 1 through 7 a preferred embodiment of the present electrically-heated wearable blanket with auto shut-off switch 10 is illustrated.

The electrically-heated wearable blanket with auto shut-off 10 includes a blanket portion 20 having a front surface 22, a back surface 24, a first edge 26, a second edge 28, a third edge 30, and a fourth edge 32. A boustrophedonic heating element 42 is disposed within the blanket portion 20. The heating element 42 is configured to heat up when an electric current is applied therethrough. The resistance of the heating element 42 dissipates electrical energy as heat when an electric current is applied therethrough. When the heating element 42 is activated, therefore, the person 70 using the electrically-heated wearable blanket with auto shut-off switch 10 enjoys a warming sensation emanating from the heating element 42 disposed within the blanket portion 20.

A first cord 44 is centrally disposed from the front surface 22 proximal the third edge 30. The first cord 44 is connected in circuit with the heating element 42. A control pad 46 is disposed endwise on the first cord 44, the control pad 46 in operational communication with the heating element 42. When the blanket portion 20 is worn, the control pad 46, depending from the end of the first cord 44, is thusly accessible to the person 70 wearing the device 10 (see FIG. 7).

A temperature control 48 is disposed on the control pad 46, the temperature control 48 including a dial 50, said dial 50 rotatable between a first position and a second position. The temperature control 48 operationally activates the heating element 42 between a minimum setting 52 and a maximum setting 54 (see FIG. 3) to define an operable temperature range.

An on-off switch 56 is disposed on the control pad 46. The on-off switch 56 alternately activates and deactivates the heating element 42 when moved between an 'on' position and an 'off' position. The temperature control 48 is in circuit with the on-off switch 56, and when the on-off switch !j6 is in the 'off' position the temperature control 48 is disconnected from the heating element 42: rotating the dial 50 between the first position and the second position, therefore, has no effect on the heating element 42 when the on-off switch 56 is in the 'off' position. Further, the on-off switch 56 automatically disables the heating element after a predetermined interval of time to ensure the electrically-heated wearable blanket with auto shut-off switch 10 does not overheat. In the preferred embodiment herein disclosed, the predetermined interval of time is considered to be ten hours.

An LED 58 is disposed on the control pad 46. The LED 58 is configured in circuit with the on-off switch 56. The LED is therefore alternately activated and deactivated synchronously when the on-off switch 56 alternately activates and deactivates the heating element 42. Thusly, when the on-off switch 56 is in the 'on' position, the LED 58 is illuminated. When the on-off switch 56 is in the 'off ' position the LED 58 is not illuminated, and a user of the device 10 knows the device 10 is deactivated.

A second cord 60 is disposed from the front surface 22, the second cord 60 disposed proximal the second edge 28 and the fourth edge 32. The second cord 60 has a plug 62 disposed endwise on thereon. The plug 62 is configured to be releasably interconnectable with a connector 64, as will be described subsequently. A third cord 66 is releasably interconnectable with the second cord 60.

The third cord 66 has a standard two-pronged plug 68 disposed endwise thereupon, the two pronged plug 68 releasably connectable with an extant 110 Volt power outlet (not shown). When connected to the first cord 44, the second cord 66 may be plugged into an extant power outlet, and the heating element 42 may be activated by means of the on-off switch 56 disposed on the control pad 46.

A fourth cord 72 is alternately releasably interconnectable with the second cord 60. The fourth cord 72 has an automobile cigarette lighter socket plug 74 disposed endwise thereupon. The fourth cord 72 therefore enables the blanket portion 20 to releasably interconnect with an extant automobile cigarette lighter socket (not shown) for use of the device 10 in automobiles, as preferred.

A rechargeable battery pack 92 is also alternately releasably interconnectable with the second cord 60. The rechargeable battery pack 92 is configured to fit into a pocket 94 disposed on the front surface 22 of the blanket portion 20. The rechargeable battery pack 92 is portable within the pocket 94.

Each of the third cord 66, the rechargeable battery pack 92, and the fourth cord 72 releasably interconnect with the plug 62 disposed on the first cord 44 by means of the abovementioned connector 64. The connector 64 is disposed upon a proximal end 76 of each of the third cord 66, the rechargeable battery pack 92, and the fourth cord 72. The connector 64 includes a pair of lock members 78 and an interconnect interface 80. The pair of lock members 78 extend from the connector 64 and releasably engage with a pair of cavities 82 disposed on the plug 6% (see FIG. 4). The interconnect interface 80 releasably receives a male portion 84 of the plug 62 and connects the first cord 44 to an external power supply by means of alternately the third 66 and fourth 72 cord, as desired, for use in the home or within an automobile, as preferred.

In the preferred embodiment herein disclosed, the first 26 and second 28 edges are envisioned to be fifty inches in length, and the third 30 and fourth 32 edges are envisioned to be sixty-two inches in length.

Figure 2:
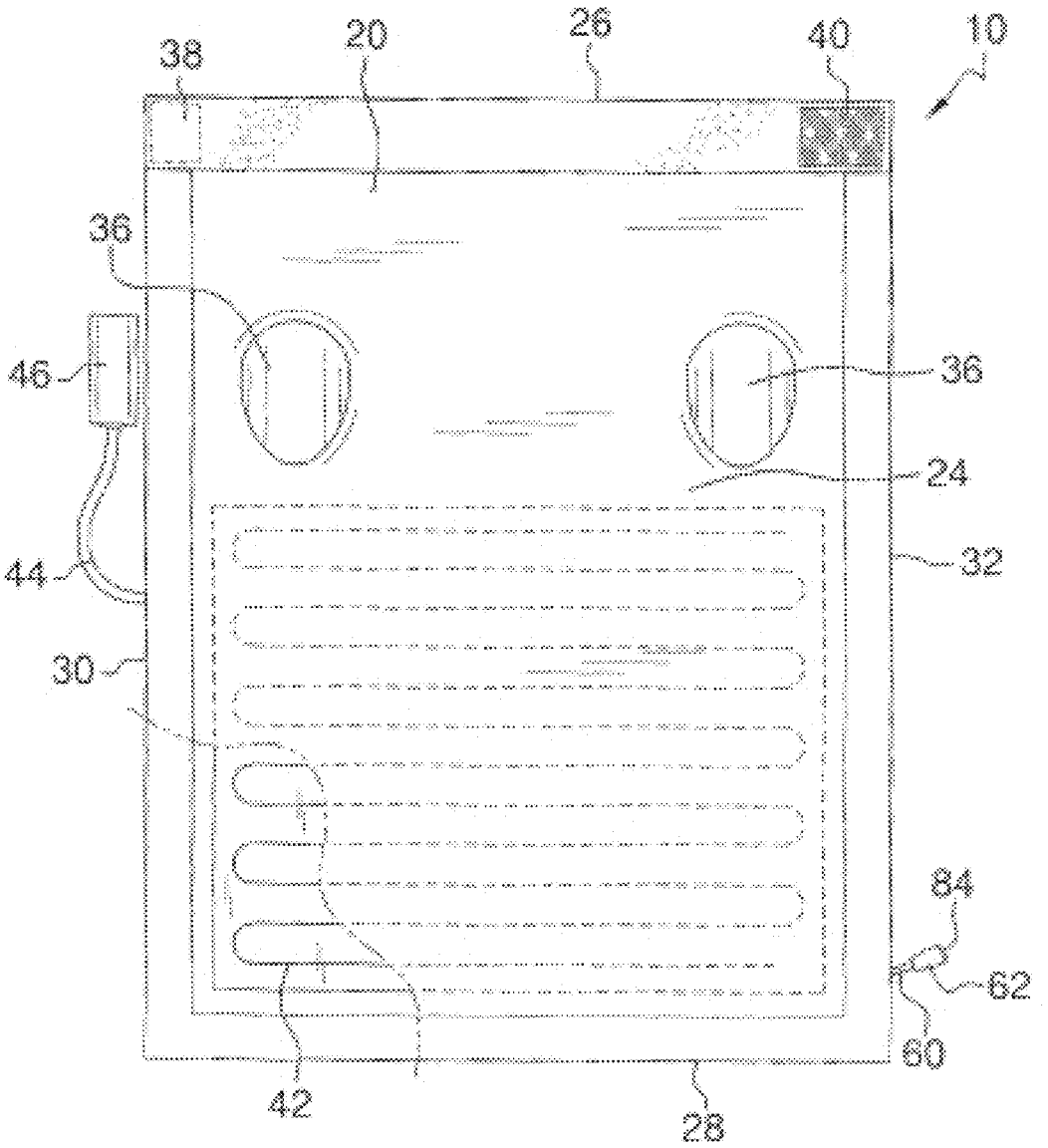
FIG. 2 is a back view.
Figure 3:
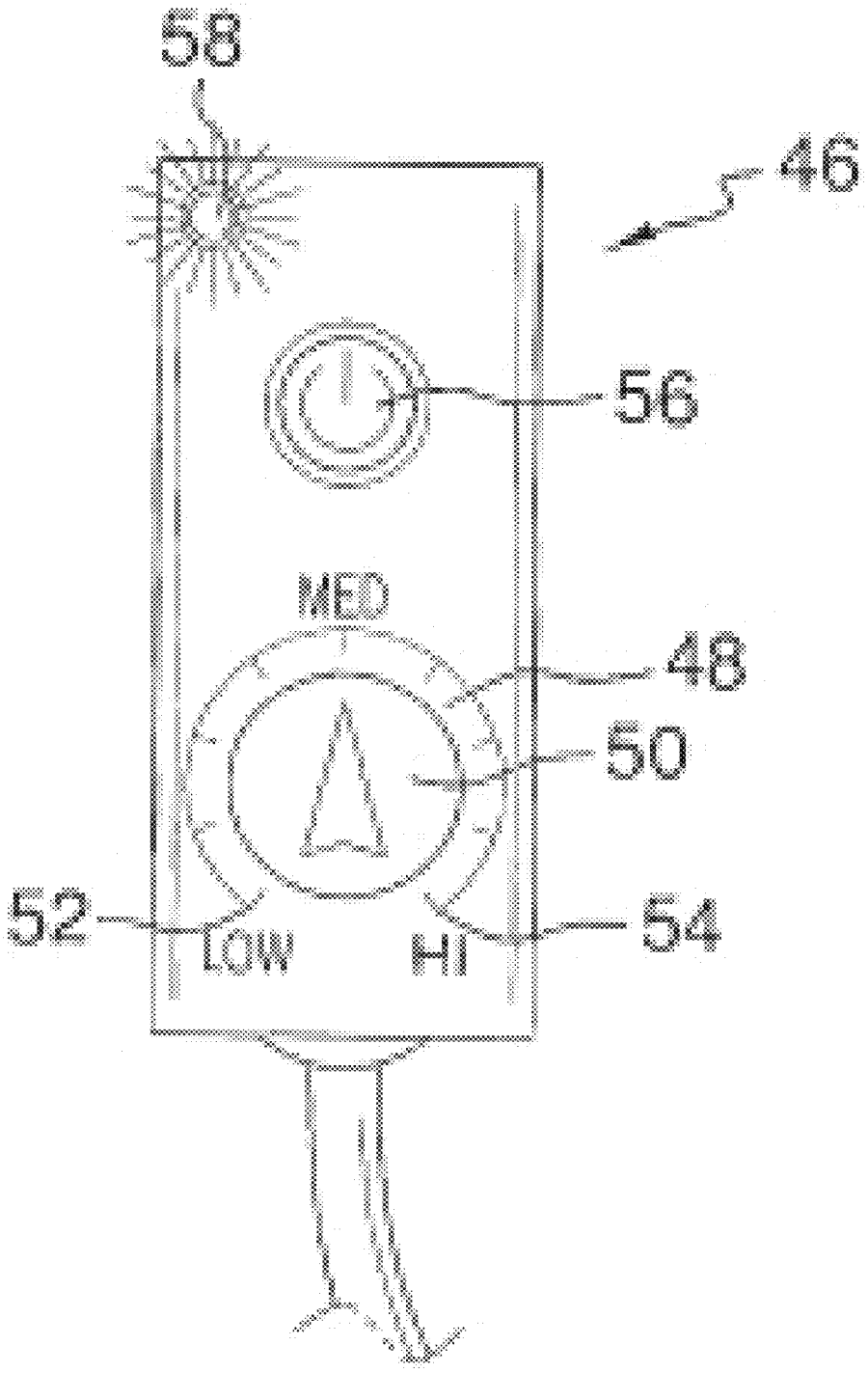
FIG. 3 is a detail view of a control pad.
Figure 4:
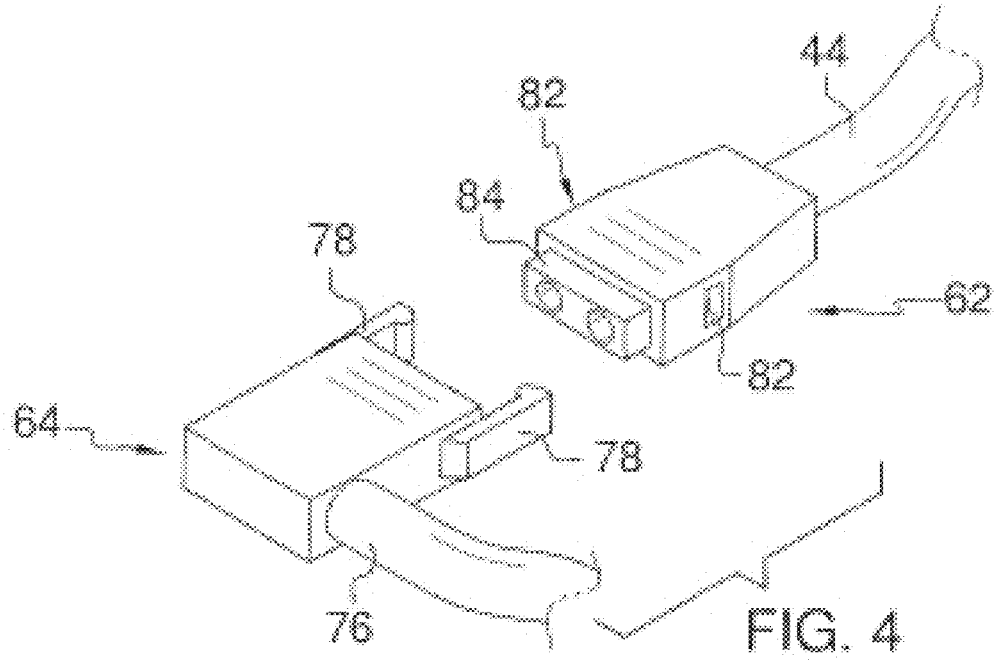
FIG. 4 is a detail view of a connector releasably attachable to a plug.
Figure 5:
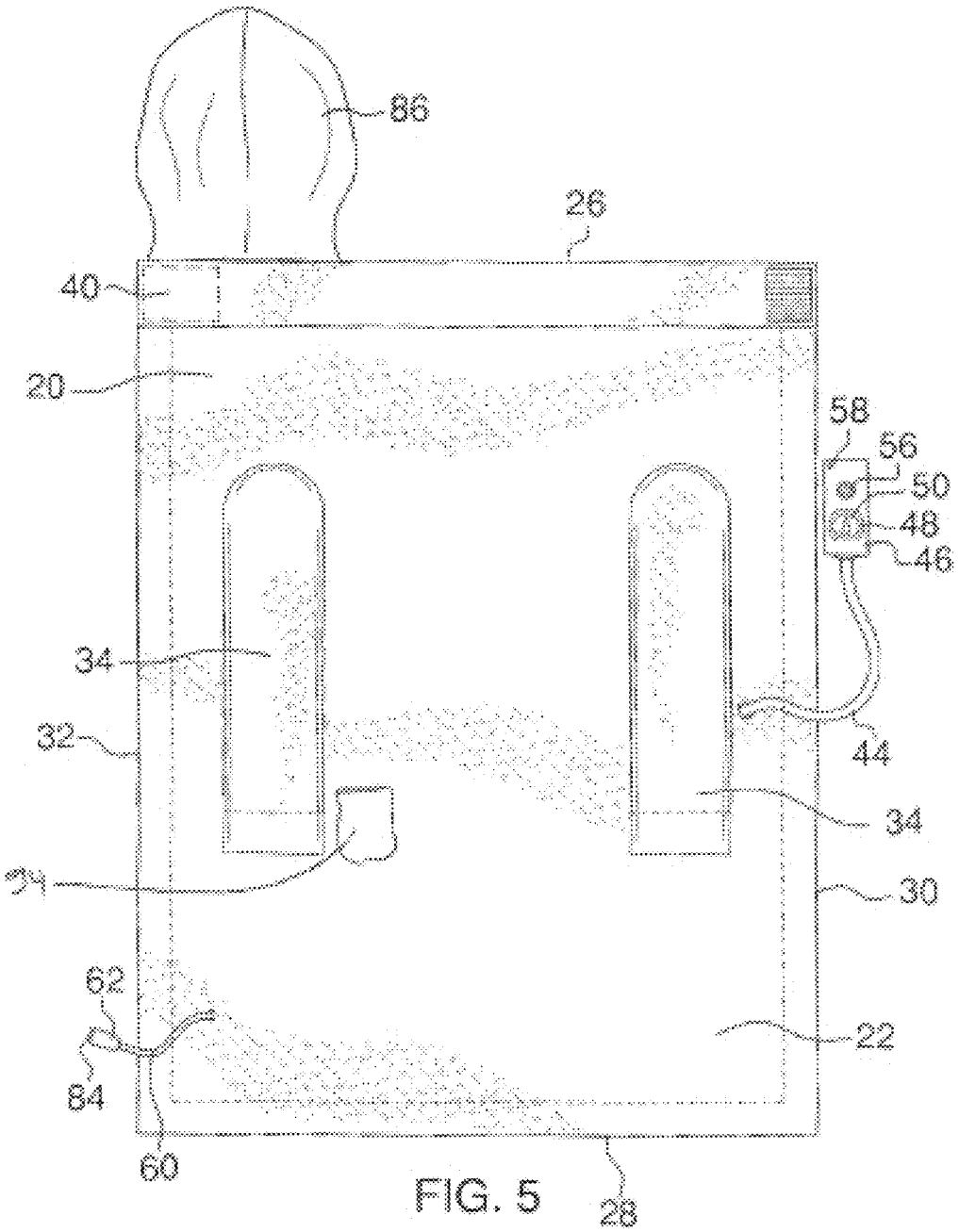
FIG. 5 is a front view of an alternate embodiment with a hood attached.
Figure 6:
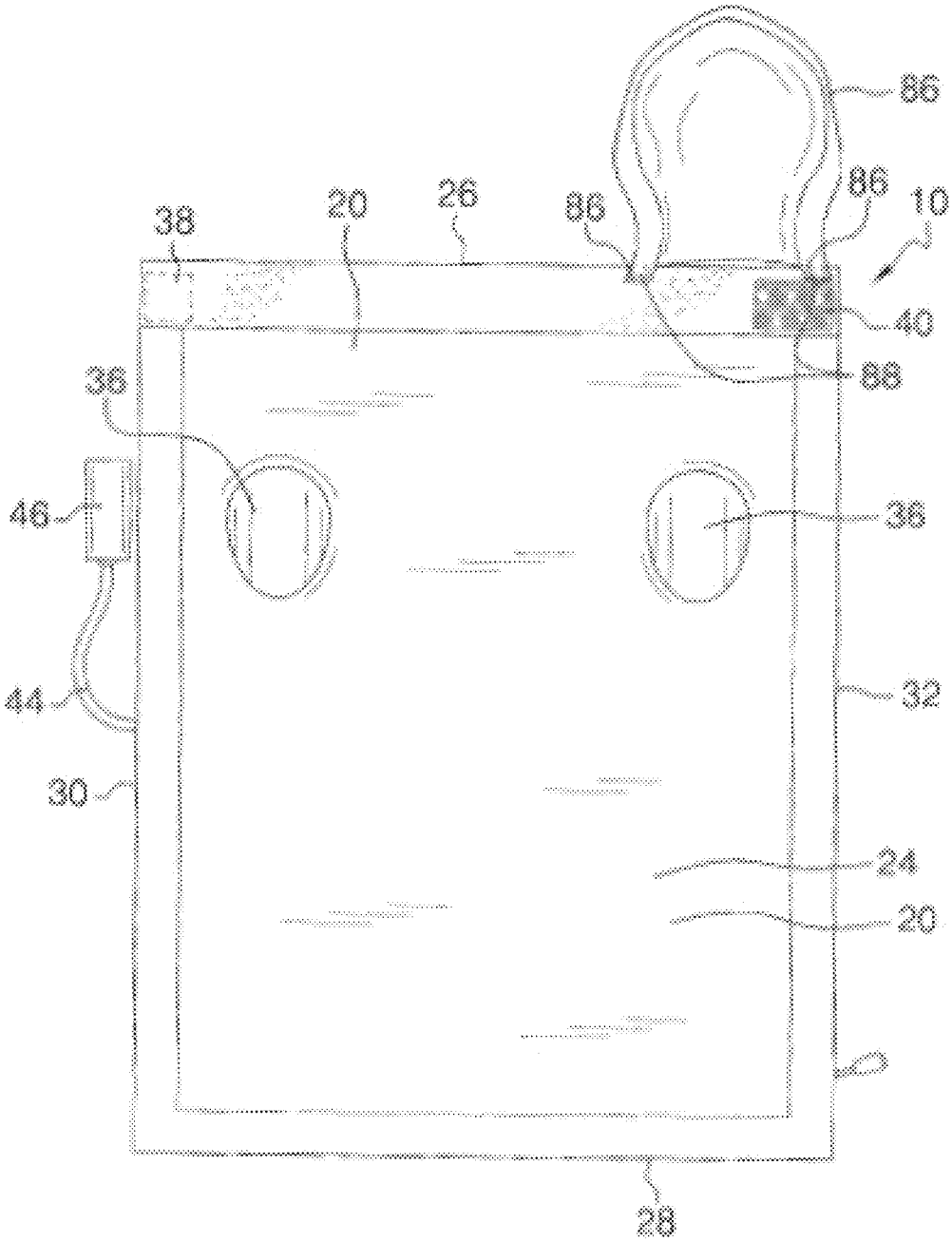
FIG. 6 is a back view of an alternate embodiment with a hood attached
Figure 7:
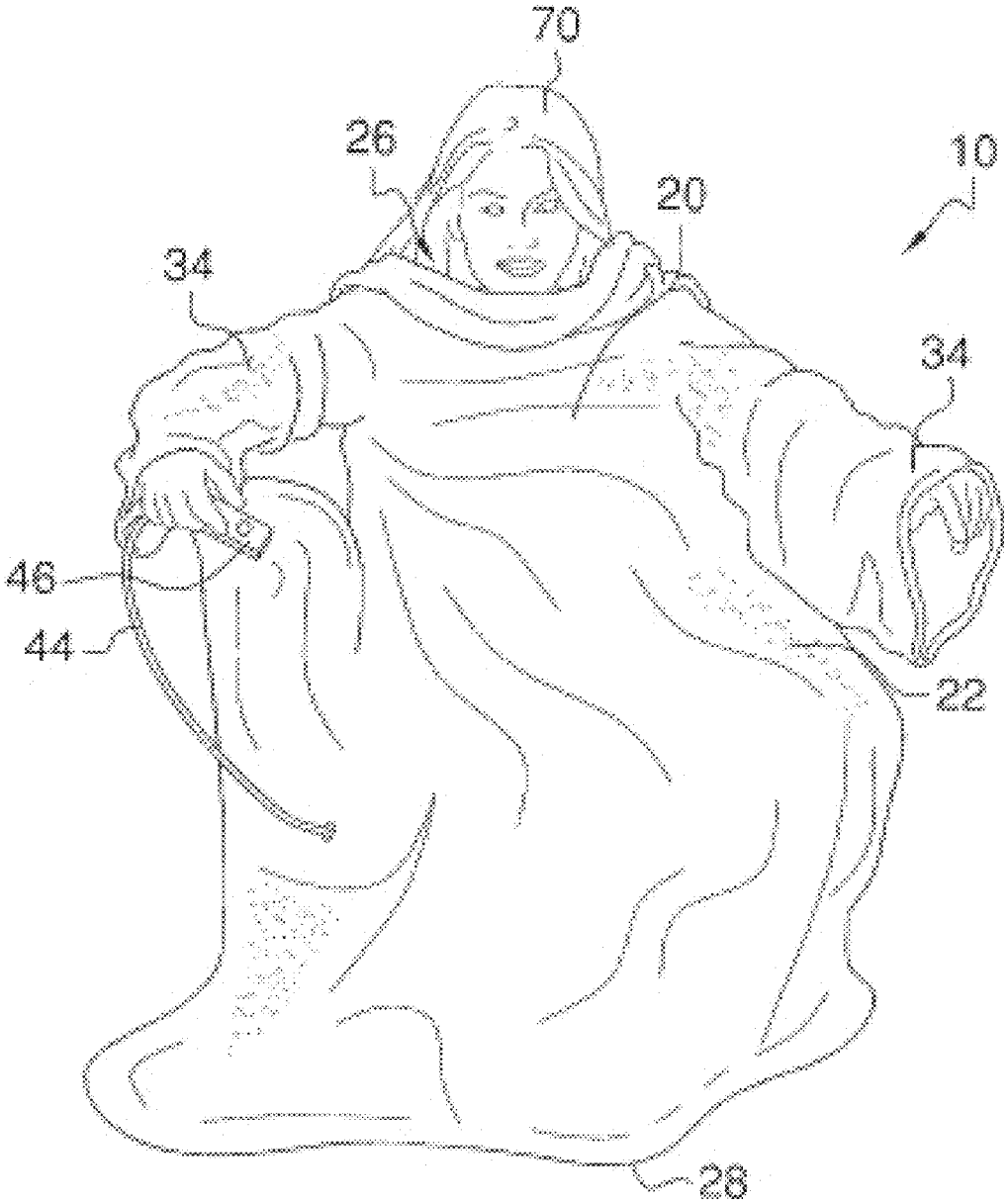
FIG. 7 is an in-use view.

Discussing now the preferred embodiment depicted in FIGS. 1, 2 and 7, and the alternative embodiment depicted in FIGS. 5 and 6, a pair of sleeves 34 is disposed on the front surface 22, each of the pair of sleeves 34 conjoined to the blanket portion 20 circumferentially around each of a pair of apertures 26. When the electrically-heated wearable blanket with auto shut-off switch 10 is worn by a person 70, the arms of the person 70 are extended into the pair of sleeves 34.

A first hook and loop fastener 38 is disposed on the front surface 22. The first hook and loop fastener 38 is disposed proximal the first edge 26 and the third edge 30. A second hook and loop fastener 40, configured to releasably engage with the first hook and loop fastener 38, is disposed on the back surface 24; the second hook and loop fastener 40 disposed proximal the first edge 26 and the fourth edge 32. When worn, the first edge 26 girdles the person 70 around the neckline, covering their shoulders, and the first hook and loop fastener 38 releasably engages with the second hook and loop fastener 40 proximal to the nape of the neck of the person 70 to releasably secure the blanket portion 20 around the person 70.

A hood portion 86 is releasably attachable to the first edge 26 of the blanket portion 20 proximal to the fourth edge 32 (see FIGS. 5 and 6). The hood portion 86 releasably attaches thereto by means of a pair of hook and loop fasteners 88 disposed upon the first edge 26 and upon an attachment portion 90 of the hood portion 86. When worn, the first edge 26 of the blanket portion 20 girdles the neck of a person 70 wearing the device 10, the first edge 26 covering the person's shoulders, and the third edge 30 and the fourth edge 32 are joined by means of the first 38 and second 40 hook and loop fasteners. The hood portion 86, attachable proximal the fourth edge 32, therefore aligns with the back of the person's head and may be removably drawn over the head to provide additional warmth, as desired.

Figure 8:
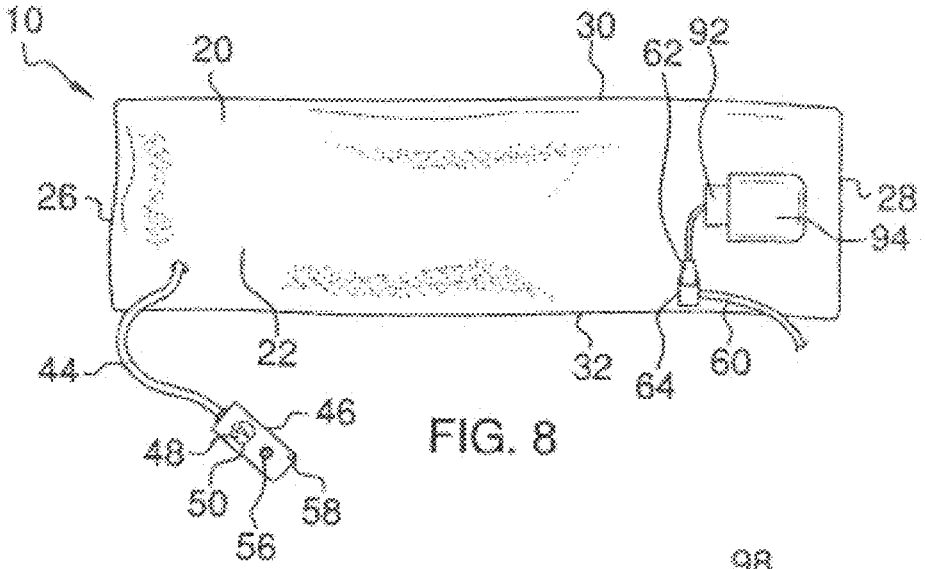
FIG. 8 is a front view of an alternative embodiment.

An additional mode of the device 10 is depicted in FIG. 8. The blanket portion 20 herein is approximately twenty-one inches in length and seven inches wide. The blanket portion 20, as depicted in FIG. 8, is envisioned to be used as a shawl. The rechargeable battery pack 92 is carried with the shawl in the pocket 94. The rechargeable battery pack 92 is removably inserted into the pocket 94 and can be recharged, as needed, in a standard 110 Volt outlet.

Figure 9:
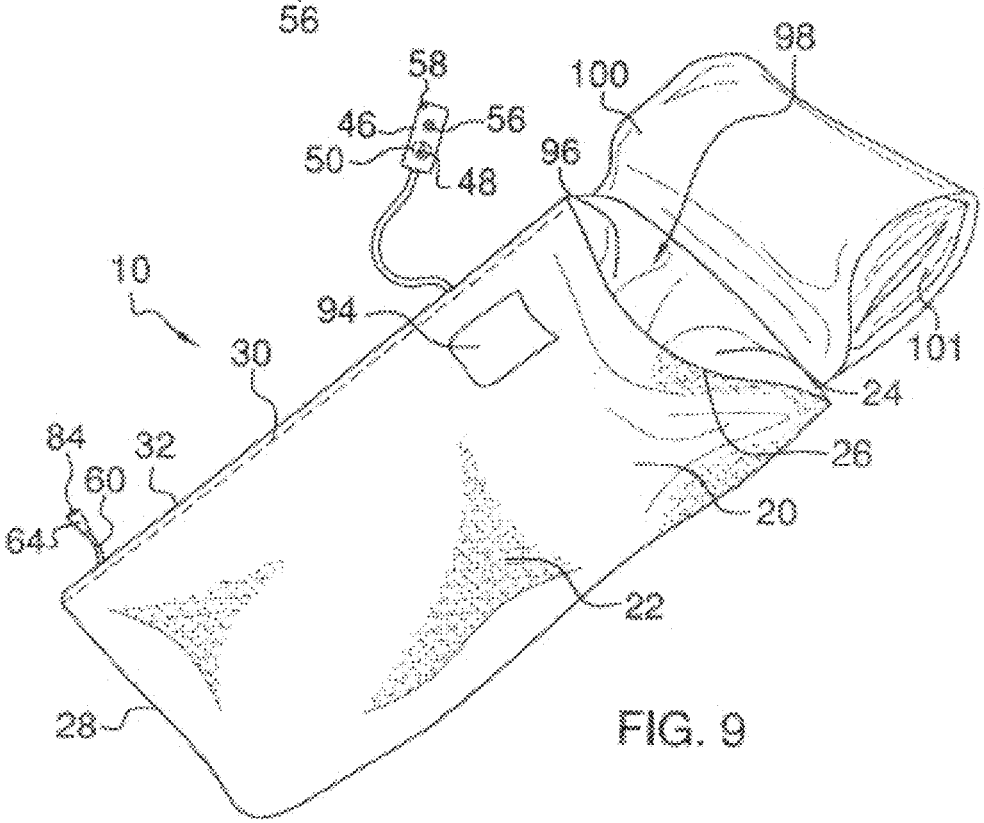
FIG. 9 is a front view of an alternative embodiment.

A further mode of the device 10 is depicted in FIG. 9. In this embodiment, the third edge 30 and the fourth edge 32 are conjoined and the second edge 28 is closed to form an interior cavity 96 surrounded by the back surface 24. A person using the device removably inserts himself into the interior cavity 96 through an open end 98. The first edge 26 is circumferentially disposed around the open end 98. A pillow portion 100 is attached to the first edge 26, the pillow portion 100 configured to removably receive and enclose an extant pillow 101 therein.

The invention claimed is:

1. An electrically-heated wearable blanket with auto shut-off switch comprising:

a blanket portion having a rectangular shape, the blanket portion comprising:
- a front surface;
- a back surface;
- a first edge;
- a second edge;
- a third edge;
- a fourth edge;

a boustrophedonic heating element disposed within the blanket portion;

a first cord disposed from the front surface, the first cord in circuit with the heating element;

a control pad disposed endwise on the first cord, the control pad in operational communication with the heating element;

a temperature control disposed on the control pad, the temperature control operationally activating the heating element between a minimum setting and a maximum setting;

an on-off switch disposed on the control pad, the on-off switch alternately activating and deactivating the heating element;

a second cord disposed form the first surface;

a plug disposed endwise on the second cord;

a pair of sleeves disposed on the front surface, the pair of sleeves being configured to extend through the thickness of the blanket portion from the back surface of the front surface;

a first hook and loop fastener disposed on the front surface, the first hook and loop fastener disposed proximal the first edge and the third edge, substantially in a first corner of the rectangular shape;

a second hook and loop fastener disposed on the back surface, the second hook and loop fastener disposed proximal the first edge and the fourth edge, substantially in a second corner of the rectangular shape; and wherein the first hook and loop fastener is wholly positioned flat on the front surface without protruding outside of the front surface;

wherein the second hook and loop fastener is wholly positioned flat on the back surface without protruding outside the back surface;

wherein the first hook and loop fastener and the second hook and loop fastener releasably secure behind a nape of a neck of a user; and wherein the plug interconnects the blanket with an external power source and the control panel operationally activates the heating element between a minimum and maximum temperature.

2. The electrically-heated wearable blanket with auto-shut off switch of claim 1, wherein the blanket portion is approximately twenty-one inches long and seven inches wide.

3. The electrically-heated wearable blanket with auto-shut off switch of claim 1 wherein the blanket portion third edge and the fourth edge are conjoined and the second edge is closed to form an interior cavity, whereby the back surface continuously lines the interior cavity.

4. The electrically-heated wearable blanket with auto-shut off switch of claim 1 wherein a pillow portion is disposed from the first edge, the pillow portion configured to enclose, and releasably receive, an extant pillow therein.

5. The electrically-heated wearable blanket with auto-shut off switch of claim 1 wherein the control pad further comprises an LED, the LED alternatively activated and deactivated synchronously when the on-off switch alternately activates and deactivates the heating element.

6. The electrically-heated wearable blanket with auto-shut off switch of claim 1 wherein the temperature control comprises a dial, the dial rotatable from a first position to a second position, wherein the first position corresponds to the minimum setting and the second position corresponds to the maximum setting.

7. The electrically-heated wearable blanket with auto-shut off switch of claim 6 wherein the minimum setting and maximum setting delimit a temperature range.

8. The electrically-heated wearable blanket with auto-shut off switch of claim 7 wherein the dial operationally communicates with the heating element continuously through the temperature range, the dial positionable continuously between the minimum setting and the maximum setting.

9. The electrically-heated wearable blanket with auto-shut off switch of claim 1 wherein the on-off switch is automatic.

10. The electrically-heated wearable blanket with auto-shut off switch of claim 1 wherein the plug releasable interconnects with a connector disposed on an extant external power source, comprising:

a pair of lock members;

an interconnected interface;

wherein the pair of lock members releasably attach to the plug and the interconnect interface releasably connects the plug in circuit with an extant external power source.

11. The electrically-heated wearable blanket with auto-shut off switch of claim 1 further comprising a hood portion, the hood portion disposed upon the back surface proximal to the first edge and the fourth edge, the hood portion configured to enclose the head of a user when the blanket portion is worn.

12. The electrically-heated wearable blanket with auto-shut off switch of claim 11 wherein the hood portion is removably attached to the back surface by means of a pair of hook and loop fasteners.

13. The electrically-heated wearable blanket with auto-shut off switch of claim 1 wherein the first edge and the second edge are approximately fifty inches in length, and the third edge and the fourth edge are approximately sixty-two inches in length.

14. The electrically-heated wearable blanket with auto-shut off switch of claim 1 further comprising a pocket disposed on the front surface.

15. The electrically-heated wearable blanket with auto-shut off switch of claim 1, further comprising:

a third cord interconnectable with the second cord, the third cord configured to interconnect with an extant power outlet and having a two-pronged plug disposed endwise thereupon, the two-pronged plug removably connected to an extant 110 volt power outlet.

16. The electrically-heated wearable blanket with auto-shut off switch of claim 1, further comprising:

a pocket disposed on the front surface;

a rechargeable battery pack interconnectable with the second cord, the rechargeable battery pack removably insertable into the pocket.

17. The electrically-heated wearable blanket with auto-shut off switch of claim 1, further comprising:

a fourth cord interconnectable with the second cord, the fourth cord configured to interconnect with an extant automobile cigarette lighter socket, whereby the fourth court further comprises an automobile cigarette lighter socket plug disposed endwise thereupon, the automobile cigarette lighter socket plug removably connectable to an extant automobile cigarette lighter socket in an extant automobile.

18. An electrically heated wearable blanket with an auto-shut off switch comprising:

a blanket portion having a rectangular shape comprising: a front surface;

a back surface; a first edge;

a second edge; a third edge;

a fourth edge;

a boustrophedonic heating element disposed within the blanket portion;

a first cord disposed from the front surface, the first cord in circuit with the heating element;

a control pad disposed endwise on the first cord, the control pad in operational communication with the heating element;

a temperature control disposed on the control pad, the temperature control operationally activating the heating element between a minimum setting and a maximum setting;

an on-off switch disposed on the control pad, the on-off switch alternately activating and deactivating the heating element;

a second cord disposed from the front surface;

a plug disposed endwise on the second cord;

wherein the plug interconnects the blanket with an extant external power source using at least one of:

a third cord interconnectable with the second cord, the third cord configured to interconnect with an extant power outlet;

a rechargeable battery pack interconnectable with the second cord;

a fourth cord interconnectable with the second cord, the fourth cord configured to interconnect with an extant automobile cigarette lighter socket; and a pair of sleeves disposed on the front surface, the pair of sleeves being configured to extend through the thickness of the blanket panel portion from the back surface to the front surface;

a first hook and loop fastener disposed on the front surface, the first hook and loop fastener disposed proximal the first edge and the third edge, substantially in a first corner of the rectangular shape; and a second hook and loop fastener disposed on the back surface, the second hook and loop fastener disposed proximal the first edge and the fourth edge, substantially in a second corner of the rectangular shape;

wherein the first hook and loop fastener is wholly positioned flat on the front surface without protruding outside of the front surface;

wherein the second hook and loop fastener is wholly positioned flat on the back surface without protruding outside the back surface;

wherein the first hook and loop fastener and the second hook and loop fastener releasably secure behind a nape of a neck of a user; and the control panel operationally activates the heating element between a minimum and a maximum temperature range.

* * * * *